US005934534A

United States Patent [19]

Schmidt et al.

[11] Patent Number: 5,934,534

[45] Date of Patent: Aug. 10, 1999

[54] SEPARATING A WEB AT A LINE OF WEAKNESS

[75] Inventors: John Schmidt; Charles H. Sauder, both of Appleton, Wis.

[73] Assignee: CMD Corporation, Appleton, Wis.

[21] Appl. No.: 08/978,080

[22] Filed: Nov. 25, 1997

Related U.S. Application Data

[62] Division of application No. 08/613,328, Mar. 11, 1996.

[51] Int. Cl.[6] ..... B26F 3/00

[52] U.S. Cl. ..... 225/4; 225/97; 225/103

[58] Field of Search ..... 225/106, 105, 225/104, 103, 97, 93, 4

[56] References Cited

U.S. PATENT DOCUMENTS

| | | | |
|---|---|---|---|
| 2,251,975 | 8/1941 | Bochow | 93/19 |
| 2,874,886 | 2/1959 | Piazze | 225/106 |
| 3,148,843 | 9/1964 | Turner et al. | 242/56 |
| 3,542,267 | 11/1970 | Saburo et al. | 225/3 |
| 3,987,949 | 10/1976 | Manning et al. | 225/106 |
| 3,991,924 | 11/1976 | Schueler | 225/100 |
| 4,284,221 | 8/1981 | Nagel et al. | 225/100 |
| 4,410,119 | 10/1983 | Hathaway | 225/4 |
| 4,529,114 | 7/1985 | Casper et al. | 225/100 |
| 4,623,081 | 11/1986 | Hain et al. | 225/105 |
| 4,697,726 | 10/1987 | Gaucher | 225/100 |
| 4,997,119 | 3/1991 | Meschi | 225/100 |
| 5,141,142 | 8/1992 | Ramsey | 225/4 |
| 5,362,013 | 11/1994 | Gietman, Jr. et al. | 242/521 |
| 5,377,929 | 1/1995 | Gietman, Jr. et al. | 242/521 |
| 5,390,875 | 2/1995 | Gietman, Jr. et al. | 242/521 |
| 5,427,294 | 6/1995 | VandenHeuvel et al. | 225/4 |

FOREIGN PATENT DOCUMENTS 1469561 1/1966 France .

*Primary Examiner*—M. Rachuba
*Assistant Examiner*—Sean Pryor
*Attorney, Agent, or Firm*—Thomas D. Wilhelm; A. Nicholas Trausch, III

[57] ABSTRACT

This invention pertains to apparatus and methods for breaking a web along spaced lines of weakness. The invention includes a compact breaker bar assembly comprising at least one breaker bar in a gap. The apparatus also includes driving apparatus to power the breaker bar assembly in breaking the web. In some embodiments, one or more breaker bars engage and stress the web along a single transverse line across the web, breaking the web. In other embodiments, at least first and second breaker bars engage and stress the web along spaced first and second transverse lines across the web. The breaker bars can be mounted on one or more rotary elements, or can be mounted on one or more belts or other breaker bar carriers, traversing closed-loop paths. In preferred embodiments, the breaker bar assembly comprises at least two breaker bars, a first breaker bar following a first straight-line path segment while a second breaker bar follows a second opposing straight line path segment, both breaker bars engaging and stressing the web at the same time, both breaker bars following the straight-line path segments before engaging the web, during engaging and stressing of the web, while breaking the web, and after breaking the web.

8 Claims, 7 Drawing Sheets

SEPARATING A WEB AT A LINE OF WEAKNESS

This is a Division of application Ser. No. 08/613,328 filed Mar. 11, 1996.

FIELD OF THE INVENTION

This invention relates generally to breaking a web along spaced lines of weakness. More specifically, the invention includes methods and apparatus for breaking continuous webs, such as plastic webs, in making plastic bags or groups of plastic bags, or other workpieces, and shingling or otherwise accumulating the workpieces.

BACKGROUND OF THE INVENTION

This invention comprises novel apparatus and methods for breaking a web along spaced lines of weakness. Apparatus for breaking a web are known in the art. Gietman et al, U.S. Pat. No. 5,362,013 discloses apparatus that breaks a plastic web along spaced perforation lines. The Gietman et al device feeds the web through a haul-in assembly 202 to a tumbler assembly 203. The tumbler assembly 203 comprises a tumbler 225 and stationary guide rolls 217–222. As shown in FIG. 3 of Gietman et al, tumbler 225 rotates in a counterclockwise direction such that spools 226 and 227 stretch, and thus break the web. Stationary guide rolls 217–222 guide the web along the desired path. Tumbler 225 also takes up slack in the web caused by the greater speed of the web through the haul-in assembly 202 as compared to the speed through the winding assembly 204.

In a commercially available embodiment of the Gietman et al device, tumbler 225 has a diameter of at least 5 inches. The tumbler assembly has a first gap element of at least about 1 inch between the haul-in assembly and the tumbler 225 and a second gap element of about 3 inches between the tumbler 225 and the nip formed by rolls 230, 231 of the winding assembly 204. The overall length of the gap along the machine direction, between guide rolls 210 and rolls 230, 231, is about 9 inches. Rolls 217–222 are used to support the web, and to ensure traversal of the web along the desired path for the length of the gap. Further, the nine inch length of the gap directly affects the overall length of Gietman et al's winder 200.

SUMMARY OF THE INVENTION

Some of the objects of the invention are obtained in a first family of embodiments comprehending apparatus for breaking a web having a length and a width, the web having spaced lines of weakness therein and traveling in a given general direction. The apparatus comprises first and second driven rolls forming a first nip. The first nip receives and transports the web through the first nip. The breaker bar assembly comprises at least first and second breaker bars, and driving apparatus driving the breaker bars in a downward translational direction. Third and fourth driven rolls downstream of the breaker bar assembly form a second nip which receives and transports the web through the second nip. A controller controls the driving of the driven rolls of the first and second nips, through the driving apparatus, and directs at least one breaker bar to engage the web, movement of the breaker bar in a downward direction causing the web to break.

In some embodiments, the breaker bar assembly comprises a first rotary element including at least first and second ones of the breaker bars. The first rotary element is powered by the driving apparatus to incrementally and intermittently rotate the breaker bars against the web with sufficient force to cause the web to break.

The breaker bar assembly can further comprise a second rotary element including at least third and fourth ones of the breaker bars. In this embodiment, the web has first and second opposing edges. The first rotary element is mounted adjacent the first edge. The second rotary element is mounted adjacent the second edge. Each breaker bar rotates in a closed path substantially perpendicular to the direction of travel of the web, the paths extending across the width of the web.

The driving apparatus preferably comprises a servomotor powering the first and second rotary elements.

The breaker bar assembly can further comprise first and second belts, preferably timing belts, and a gear box, utilized by the servomotor to rotate the first and second rotary elements. Any timed drive can be used for first and second belts. Timed belts are preferred, though timed chains and the like can be used.

Preferably, the breaker bars are disposed in a common plane extending across the web. The controller drives the first and second rotary elements in opposite directions, and times rotation of the rotary elements such that each respective breaker bar on the first rotary element cooperates with a respective breaker bar on the second rotary element across the surface of the web such that the respective breaker bars concurrently engage, and break, the web. Cooperating ones of the breaker bars are preferably substantially aligned with each other when the respective breaker bars cooperatively engage and break the web. The cooperating ones of the breaker bars preferably define equal and opposite angles with the web.

In preferred embodiments, the breaker bars travel in paths substantially perpendicular to the direction of travel of the web at engagement with the web.

In some embodiments, the breaker bar assembly comprises a first belt, supporting at least first and second ones of the breaker bars. The first belt is mounted on first guide apparatus, and powered by the driving apparatus to incrementally and intermittently advance the breaker bars along a first elongate closed path. The breaker bar assembly can include a second belt, supporting at least third and fourth ones of the breaker bars. The second belt is mounted on second guide apparatus and powered by the driving apparatus to incrementally and intermittently rotate the third and fourth breaker bars along a second elongate closed path. The first belt is mounted adjacent the first edge. The second belt is mounted adjacent the second edge. Each belt is preferably a timing belt, and each guide apparatus is preferably a respective timing pulley.

It is preferred that major portions of respective first and second elongate paths extend in straight lines, substantially perpendicular to the direction of travel of the web, preferably parallel to each other. Preferably, the breaker bars on the first belt travel in a plane in common with respective breaker bars on the second belt. In this embodiment, the controller drives the first and second belts in opposite directions, and times advance of the breaker bars along the first and second paths such that respective pairs of breaker bars cooperatively engage and break the web.

Preferably, the web has spaced lines of weakness extending thereacross, defining respective bags in the web. The apparatus further can include a sensor which senses each line of weakness in the web.

In a shingling mode of operation, the controller operates the breaker bar assembly to break the web in response to each sensing of a line of weakness by the sensor, each breaking of the web at each line of weakness making an individual workpiece. In this shingling mode, third and fourth driven rolls are driven at a slower line speed than the first and second driven rolls, thereby shingling or overlapping the workpieces between the nips. Thus, a leading portion of the remainder of the web, after each breaking at a line of weakness, is placed on a trailing portion of the next succeeding downstream workpiece between the first and second nips.

The invention further contemplates driving the respective breaker bar in a preferably downward translational direction against the web, each driving of the breaker bar assembly against the web bringing engagement between the breaker bar assembly and the web at a single line across the width of the web. The engagement causes the web to break at a line of weakness between at least one breaker bar and the first nip.

In some embodiments, the breaker bar assembly comprises at least first and second breaker bars mounted for traversing first and second elongate closed paths, a first one of the breaker bars being driven in a first substantially straight line direction along a first path segment into stressing engagement with the web at a first location along the length of the web while a second one of the breaker bars is driven in a second opposite substantially straight line direction along a second path segment into stressing engagement with the web at a second location, displaced from the first location along the length of the web. The combined stressing engagements of the first and second breaker bars break the web. Each of the breaker bars moves in a respective straight line direction before engagement with the web, during subsequent stressing engagement with the web, and after the web breaks.

In some embodiments, the straight line path segment in each direction comprises a distance of at least about 4 inches.

In preferred embodiments, the second path segment is spaced from the first path segment by a distance of no more than 1.5 inches, preferably between about 0.25 inch and about 1 inch. The first and second path segments can comprise first and second portions of a single elongate closed path.

In some embodiments, the breaker bar assembly comprises a first drive belt mounted on first guide apparatus and disposed adjacent the first edge of the web. The breaker bar assembly further can comprise a second drive belt mounted on second guide apparatus and disposed adjacent the second edge of the web. Each breaker bar is preferably mounted to both the first and second drive belts and extends transversely across the web. The second drive belt and second guide apparatus are preferably substantially aligned, across the web, with the first drive belt and first guide apparatus. The driving apparatus drives the first and second belts in common, advancing the breaker bars along the respective paths.

In some embodiments where the first drive belt is mounted on first guide apparatus adjacent the first edge of the web and the second drive belt is mounted on second guide apparatus adjacent the second edge of the web, first and third upwardly driven breaker bars are mounted on respective first and second belts in substantial alignment with each other. Second and fourth downwardly driven breaker bars are mounted on the respective first and second drive belts in substantial alignment with each other, such that the breaker bars on each belt advance in respective upward and downward straight line directions before engaging the web.

In some embodiments, the gap between the web drive assembly and the nip subassembly is less than about 3 inches. Preferably, the gap is between about 1 inch and about 2 inches.

In preferred embodiments, the breaker bars engage the web and exert a take-up force across the width of the web, taking up slack in the web, and continuing to take up the slack, before breaking the web.

The invention further contemplates a method of breaking a web at spaced lines of weakness in the web. The method comprises advancing the web through a first nip formed by first and second rolls, drawing the web through a second nip formed by third and fourth rolls, and through a breaker bar assembly between the first and second nips, sensing a line of weakness, and driving at least one of the breaker bars in a downward direction, thus engaging the web, and breaking the web at the line of weakness. The breaking of the web forms a separated workpiece having a trailing portion, and correspondingly forms a leading portion of the remainder of the web. The breaker bar assembly comprises at least first and second breaker bars, and driving apparatus driving the breaker bars.

In preferred embodiments, the method includes incrementally and intermittently rotating first and, preferably, second rotary elements in response to successive signals from the controller, in closed paths substantially perpendicular to the direction of travel of the web, and extending across the width of the web.

In some embodiments, the method comprises advancing a first drive belt, and incrementally and intermittently advancing at least first and second breaker bars along a first elongate closed path. At least third and fourth breaker bars on a second drive belt can be cooperatively incrementally and intermittently advanced along a second elongate closed path.

In some embodiments, the breaker bars travel in path segments substantially perpendicular to the direction of travel of the web, and extend across the width of the web, during, and before or after, or both, engagement with the web.

The invention further comprehends a method of breaking a web including driving a first one of the breaker bars in a first substantially straight line direction along a first path segment into stressing contact with the web at a first location along the length of the web while driving a second one of the breaker bars in an opposite substantially straight line direction along a second path segment into stressing contact with the web at a second location along the length of the web. The combined stressing contacts of the breaker bars break the web at the respective line of weakness.

In some embodiments, the method includes sensing each line of weakness, and only when the last of a predetermined number of lines of weakness has been sensed, breaking the web at the last line of weakness so sensed, when the last line of weakness is downstream of the first nip.

In some embodiments, the method includes sensing each line of weakness, and breaking the web at each line of weakness sensed, each breaking of the web at a line of weakness making an individual workpiece comprising a single bag.

Figure 1:
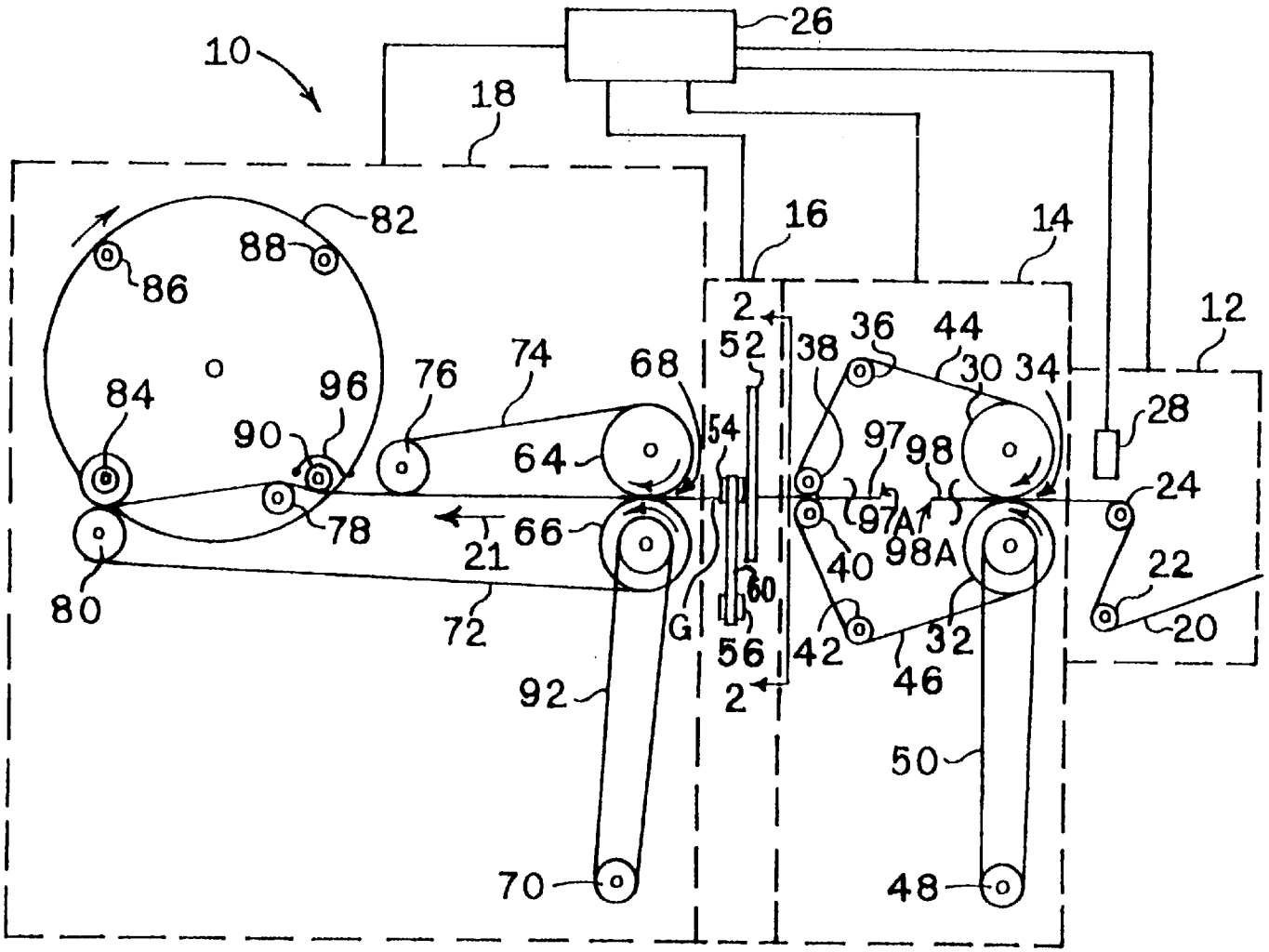
FIG. 1 shows a representative side view of a first embodiment of a web handling machine of the invention.

The invention is not limited in its application to the details of construction and the arrangement of the components set forth in the following description or illustrated in the drawings. The invention is capable of other embodiments or of being practiced or carried out in various ways. Also, it is to be understood that the terminology and phraseology employed herein is for purpose of description and illustration and should not be regarded as limiting. Like reference numerals are used to indicate like components.

DETAILED DESCRIPTION OF THE ILLUSTRATED EMBODIMENTS

FIG. 1 illustrates a web handling machine 10 including a dancer assembly 12, a web drive assembly 14, a breaker bar assembly 16 and a winding assembly 18.

The basic overall web handling machine 10 of FIG. 1, except for the breaker bar assembly 16, is similar to the machine set forth in Gietman et al, U.S. Pat. No. 5,362,013, hereby incorporated by reference in its entirety. Web 20 has a width "W" (FIGS. 6 and 7) and a continuous length, and travels in the direction shown by arrow 21.

Referring again to FIG. 1, dancer assembly 12 receives web 20 from a web source (not shown). In dancer assembly 12, a pair of rolls 22, 24 assist in controlling the tension on web 20. A position sensor, not shown, associated with dancer roll 24 sends position signals to electric controller 26 at closely spaced intervals. Controller 26 uses the position signals to make ongoing adjustments to the speed at which web 20 is drawn into the machine 10, thus to maintain dancer roll 24 generally at a midpoint in its range of movement.

Dancer assembly 12 includes a line of weakness sensor 28. Sensor 28 senses spaced lines of weakness, such as perforations, in web 20 and provides a signal to electric controller 26 as each line of weakness is sensed. A variety of sensors are available for sensing lines of weakness. For example, a pair of electrodes (not shown) can be provided in cooperative relationship above and below web 20. A voltage can be applied between the electrodes, and through the web. The voltage creates an electric arc between the electrodes when a perforation passes between the electrodes. Multiple electrodes can be placed at multiple locations across web 20. Sensed signals are sent to electric controller 26 which controls various elements of web handling machine 10.

Web drive assembly 14 includes first and second rolls 30 and 32, which are urged against each other, thus defining a first nip 34 therebetween. Support belt 44 is stretched about, and traverses, a first path about rolls 30, 38 and 36. Support belt 46 is stretched about, and traverses, a second path about rolls 32, 40 and 42. Rolls 38 and 40 are slightly spaced from each other. Similarly, support belts 44 and 46 are spaced from each other at rolls 38, 40. Rolls 38, 40 and support belts 44, 46 provide guiding support for the web at rolls 38, 40, but not a speed-controlling nip as at nip 34.

Support belts 44 and 46 are preferably nylon, or other suitable polymer or rubber. Support belts 44 and 46 are preferably full-width conveyor belts, but may comprise separate ropes or strands disposed in grooves (not shown) in their respective guide rolls. Support belts 44 and 46 guide web 20 through web drive assembly 14.

Driving apparatus 48 drives drive belt 50, and thus drives roll 32 which, in turn, drives roll 30. Driving apparatus 48 can comprise a servomotor, a standard AC motor or the like. Electric controller 26 controls the speed of driving apparatus 48 and thus the speed at which web 20 is drawn into web drive assembly 14 by rolls 30, 32 at nip 34.

First nip 34 provides a first nip line against which web 20 can be broken. Other structures providing the required nip can be substituted for the web drive assembly illustrated.

Figure 2:
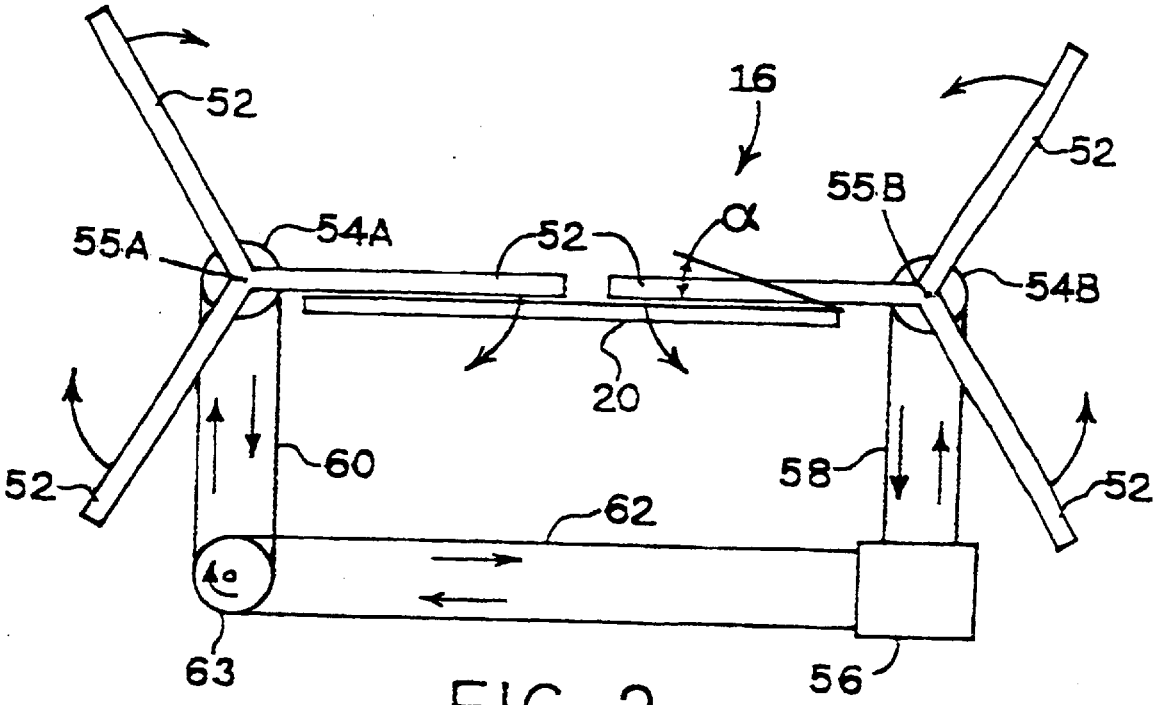
FIG. 2 shows a representative front view of the breaker bar assembly taken at 2—2 of FIG. 1.

As illustrated in FIG. 2, breaker bar assembly 16 includes breaker bars 52, mounted on first and second rotary elements 54A, 54B. Rotary elements 54A, 54B rotate about respective axes of rotation 55A, 55B which extend along the length of web 20. While three breaker bars 52 are illustrated on each rotary element 54 a greater or lesser number of breaker bars 52 can be utilized.

In breaker bar assembly 16, drive apparatus 56 drives first drive belt 58 and transfer belt 62. Transfer belt 62 drives second drive belt 60 through guide apparatus 63. Guide apparatus 63, preferably comprises a pulley or the like. Drive belt 58 thus drives rotary element 54B in a counterclockwise direction, while drive belt 60 drives rotary element 54A in a clockwise direction. Accordingly, the respective rotary elements 54A, 54B drive the respective breaker bars 52 about closed paths, and downwardly into cooperative and stressing engagement with web 20.

Driving of the rotary elements 54A and 54B is timed such that breaker bars from the two rotary elements cooperatively engage the web, preferably simultaneously, as illustrated in FIG. 2, to break the web at a respective line of weakness. As each pair of breaker bars breaks the web at a line of weakness, the next pair of breaker bars moves, on rotary elements 54A, 54B, into the "ready" position above the web.

With the web broken, the rotary elements stop rotation until again signalled by controller 26 to rotate the next pair of breaker bars into engagement with the web. Thus, rotary elements 54A and 54B intermittently rotate in less than full circle increments, to engage and break the web each time they are so signalled by controller 26. Controller 26 can issue such signal at each sensed line of weakness, or after sensing a predetermined number of lines of weakness.

The respective closed paths of the breaker bars extend across the width of the web. Drive apparatus 56 provides incremental and intermittent driving of belts 58, 60, 62, and thus the incremental and intermittent driving of breaker bars 52 downwardly against web 20 with web-breaking force, breaking the web at respective lines of weakness.

Figure 3:
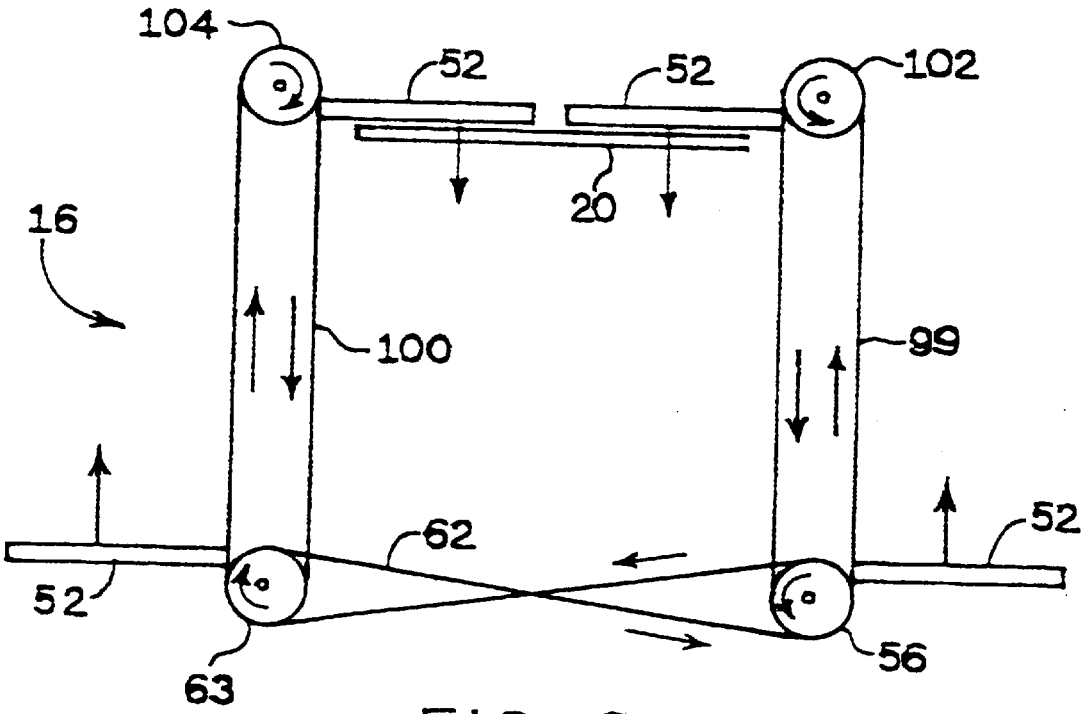
FIG. 3 shows a representative front view of a second embodiment of the breaker bar assembly.

While belt 58 advances in a counterclockwise direction, transfer belt 62 advances in a clockwise direction, as enabled by a gear box in driving apparatus 56. The gear box can be omitted, and belts 58 and 62 driven off a common drive pulley. Transfer belt 62 is then crossed between drive apparatus 56 and guide apparatus 63, as shown in FIG. 3, in order to obtain the proper direction of rotation at guide apparatus 63.

Rotary elements 54A, 54B preferably comprise pulleys or sprockets with breaker bars 52 mounted from the pulleys or sprockets. The leading edges of breaker bars 52 engage web 20. The leading edges typically define arcuate contours as opposed to sharp edges (not shown). In some embodiments, a sharp leading edge is acceptable, but generally a more arcuate contour is preferred.

Typically, the overall cross-sections of breaker bars 52 are round, or other arcuate shapes (not shown). Polygonal cross-sections, and combination polygonal and arcuate cross-sections (not shown) are also acceptable. A diameter of ⅝ inch is preferred for breaker bars 52 although other sizes and shapes can function properly. The general requirement for breaker bars 52 is a cross-section having sufficient strength to tension and break web 20. In the preferred embodiments where the web is broken at lines of weakness displaced from the lines of contact between the breaker bars 52 and the web, the breaker-bars 52 should be free from sharp edges along all surfaces which contact the web.

Rotary elements 54A, 54B support respective breaker bars 52 in a common plane extending across web 20. Electric controller 26 drives rotary elements 54A, 54B in opposite directions while timing rotation of first and second rotary elements 54A, 54B such that each respective breaker bar 52 on first rotary element 54A is substantially aligned with, and cooperates with, a respective breaker bar 52 on second rotary element 54B at and across the top surface of web 20. Thus, the respective two operative breaker bars 52 (FIG. 2) at the top of web 20 are generally oriented parallel to, and transversely across, the web at first engagement with the web. The operative breaker bars 52 define equal and opposite angles "$\alpha$" with the web at first engagement with the web. The angles can be from zero (parallel to the web), up to about plus or minus 20 degrees with respect to the web.

Before breaking the web, breaker bars 52 preferably engage web 20 and apply modest tension, taking up slack without applying enough force to break the web. Controller 26 senses the speed of web 20 entering the gap, and the speed of the workpieces or bags leaving the gap through nip 38, calculates the amount of slack web material generated at any given point in time, and the dynamically changing positions of the breaker bars needed to take up the slack as the slack develops. The controller accordingly issues commands to the breaker bar drive, positioning the breaker bars to take up the slack so calculated.

In winding assembly 18, driving apparatus 70 drives drive belt 92, and thus drives roll 66 which in turn drives roll 64. Driven rolls 64 and 66 define the second nip 68. Web support belt 72 traverses a closed elongate path about guide rolls 78, 80 and driven roll 66. Web support belt 74 traverses a closed elongate path about guide roll 76 and driven roll 64. Web support belts 72 and 74 are similar to web support belts 44 and 46 of web drive assembly 14.

Web support belt 72 is preferably a flat, full-width conveyor belt. Web support belt 72 conveys workpieces severed from web 20 toward spindles 84, 86, 88 and 90 for winding. An air horn 96 cooperates with spindle 90 to begin wrapping the workpieces thereabout.

Electric controller 26 controls the timing and operation of the elements of web handling machine 10. While a particular winding assembly 18 has been disclosed, other winding assemblies or web processing machines are contemplated as being within the scope of the invention.

In FIG. 1, support belts 44, 46 are shown as cut away between nip 34 and rolls 38, 40, illustrating a preferred location where web 20 breaks when stressed by breaker bars 52. A trailing portion 97 having a trailing edge 97A is shown as a first workpiece formed by a break in web 20, and a leading portion 98 having a leading edge 98A is shown as a second upstream portion not yet broken from the web, and which will form the next succeeding workpiece when broken away from the web at e.g. the next line of weakness.

The term "bag" used throughout this disclosure is defined as a section of the web between lines of weakness. Web 20 preferably comprises precursors of plastic bags of a selected size. Preferably, the web, and thus the bags, are made of a plastic material or the like. However, the bags referred to herein can comprise other materials, such as sheets or films which are not bags in the traditional sense. Bags need not have an opening on any end or side.

The term "workpiece" as used herein is a section of web 20 which has been broken or otherwise severed from the continuous web. Thus a "workpiece" does, in some embodiments of application of the invention, contain a plurality of "bags."

Each workpiece can comprise a single bag or a plurality of bags with unbroken lines of weakness between the bags. The plurality of bags can comprise any number of bags, such as 25, 50 or 100 bags which can be wound on a spindle such as for storage or for placement into a package.

The invention works as follows. Web 20 is drawn into dancer assembly 12 by the draw at nip 34. Dancer assembly 12 thus receives web 20 into the machine. In dancer assembly 12, rolls 22, 24 control the tension on web 20. A position sensor (not shown) associated with dancer roll 24 sends position signals to electric controller 26 to make ongoing adjustments to the speed at which web 20 is drawn into the machine 10.

Breaker bars 52 generally do not cut the web. Referring to FIGS. 1–3, with the web firmly gripped at nip 34, the leading edge of the web advances into nip 68. With the web firmly held, or anchored, in both nips 34 and 68, breaker bars 52 advance downwardly against the top surface of the web, applying tensile-type stress on the web, breaking the web at a line of weakness between the first and second nips, preferably between first nip 34 and breaker bar assembly 16.

While the drive belts 58, 60 and 62 preferably comprise timed belts, a variety of other structures can be devised to replace the drive belts. For example, individual drive motors controlled by controller 26 can provide the same function.

Line of weakness sensor 28 provides a signal to controller 26 as each line of weakness is sensed. From dancer assembly 12, web 20 follows a path between support belts 44, 46 from nip 34 to rolls 38, 40.

Controller 26 controls breaker bar assembly 16, moving breaker bars 52 downwardly to break web 20 after the sensed line of weakness passes the first nip 34, and preferably before the line of weakness reaches rolls 38, 40. Breaking the web forms a workpiece having a trailing portion 97, including a trailing edge 97A, and a leading portion 98 of the remainder of the web, having a leading edge 98A. Breaking of web 20 is repeated at selected spaced lines of weakness in response to successive signals from controller 26. In some embodiments, the breaker bars 52 advance to break the web in response to each line of weakness. In other embodiments, the breaker bars 52 advance to break the web only after a predetermined number of lines of weakness have been sensed.

Second nip 68 continues to draw the broken away workpiece therethrough, the workpiece being guided by web support belts 72 and 74 toward turret 82. Air horn 96 cooperates with turret 82 and spindles 84, 86, 88 and 90 to wind the leading edge of the respective bag or workpiece onto the respective spindle. After the leading portion of the first workpiece or workpieces to be wound on the spindle has been secured to the spindle (e.g. spindle 84), the turret rotates while the spindle winds the web, respectively moving the next spindle (e.g. spindle 90) to the position shown in FIG. 1.

In a continuous mode of operation, web 20 is wound, preferably as a roll of bags connected to each other by the spaced lines of weakness. Winding proceeds until the winding of trailing edge 97A of the last bag to be wound on the roll. Electric controller 26 controls winding assembly 18 so leading edge 98A of the next group of bags is then wound about the spindle near air horn 96 and turret 82 again rotates. The selected spindle 84, 86, 88 or 90 having the completely wound roll, rotates, with the turret, to the next position. A push-off device (not shown) removes the wound roll of bags from the selected spindle. In this continuous mode of operation, web 20 is broken at a line of weakness when a predetermined number of lines of weakness have been sensed by sensor 28. The predetermined number of lines of weakness corresponds to a respective preselected number of bags. In this mode of operation, the preselected number of bags are wound onto a first spindle, and then another group of bags, typically of like number, is wound continuously and sequentially onto a succeeding spindle.

In the continuous mode of operation, winding assembly 18 preferably operates at substantially the same speed as web drive assembly 14. This avoids slack in web 20 passing through breaker bar assembly 16.

In a shingling mode of operation, sensor 28 detects each line of weakness, and controller 26 controls breaker bar assembly 16 to break the web into individual workpieces by breaking the web at each line of weakness. Nip 68 draws the web at a slower speed than web drive assembly 14, thus creating slack in the web 20 as the web traverses across gap "G" (illustrated in FIGS. 1 and 5). Breaker bar assembly 16 takes up the slack created by the speed differential by bringing respective breaker bars 52 into engaging contact with the web, using modest force sufficient to take up, and continue taking up, the accumulating slack, but insufficient to break the web at the approaching line of weakness. At the appropriate time, the force is quickly increased sufficiently to break the web at the respective line of weakness. This process is repeated at each line of weakness.

As the trailing edge 97A of the leading workpiece moves down to a lower position below nips 34 and 68, due to the combination of gravity and the downwardly-directed breaking force, the leading edge 98A of the remainder of the web 20 feeds past rolls 38, 40, and over the trailing edge 97A, shingling the leading edge 98A over trailing portion 97. The amount of the remainder of the web which overlies trailing portion 97 depends on the difference in the drive speeds at nips 34 and 68. Increasing the speed differential increases the amount of web 20 which overlies the leading workpiece. Winding assembly 18 then winds the shingled workpieces into a roll on spindle 84, 86, 88, or 90, as earlier described.

Electric controller 26 can comprise a computer, a microprocessor or other digital electronic device capable of controlling web handling machine 10. Further, electric controller 26 can also comprise an analog electric circuit that receives inputs from sensor 28, dancer roll 24 and other elements, while controlling driving apparatus 48 and 70, breaker bar assembly 16, turret 82 and air horn 96 as well as other elements of web handling machine 10. Controller 26 can take on other forms. For example, controller 26 can be a pneumatic or hydraulic controller using respective pneumatic or hydraulic logic and control devices.

FIG. 3 illustrates another embodiment of the breaker bar assembly 16, including first and second drive belts 99, 100 and breaker bars 52. Drive apparatus 56 can comprise a servomotor, a standard AC motor or the like. Driving apparatus 56 powers guide drive apparatus 63 through crossed transfer belt 62. Respective drive belts 99 and 100 are supported about their respective paths by respective first and second guide apparatus 102 and 104 in combination with drive apparatus 56 and drive apparatus 63. Guide apparatus 102 and 104 typically comprise pulleys, sprockets, or the like.

Drive belts 99 and 100 preferably comprise timed belts or the like. The breaker bars 52 are securely mounted to the respective drive belts and extend outwardly from drive belts 99 and 100 as shown in FIG. 3. Breaker bars 52 are powered in a downward direction to break web 20. By breaking web 20 in a downward direction, trailing edge 97A of a first workpiece is urged downward to a position below nips 34 and 68. Leading edge 98A of the remainder of the web feeds as a straight line extension of belts 44, 46 from rolls 38, 40, thus feeding over the trailing edge 97A. This effectively shingles the leading edge 98A over the trailing portion 97.

Still referring to FIG. 3, two breaker bars 52 are shown on each drive belt 99 and 100. A greater number can be utilized. Breaker bars 52 are carried by drive belt 99 along the entirety of its closed path via guide apparatus 102 and drive apparatus 56 to engage web 20 in a downward translational direction. Drive apparatus 56 drives the drive belt 99, which preferably is a timed belt, along the closed path, including about guide apparatus 102. Major portions of the elongate path extend in a straight line, substantially perpendicular to the direction of travel of the web. Drive belt 100 and respective breaker bars 52 operate essentially the same way and are in a common plane with breaker bars 52 on first drive belt 99. The elongates paths of first and second drive belts 99 and 100 preferably are identical in size and shape.

In operation with respect to FIG. 3, electric controller 26 drives belts 99 and 100 in opposite directions, illustrated by the arrows, and thus controls advance of breaker bars 52 along first and second paths substantially perpendicular to the direction of travel of the web. Thus, respective breaker bars 52 are substantially aligned across the top surface of web 20 before engaging and breaking the web. Breaker bars 52 preferably take up slack in web 20 by applying an ongoing take-up force, taking up and sustaining the slack in the web after leading edge 98A is engaged in nip 68, and before operating to break web 20.

Figure 3A:
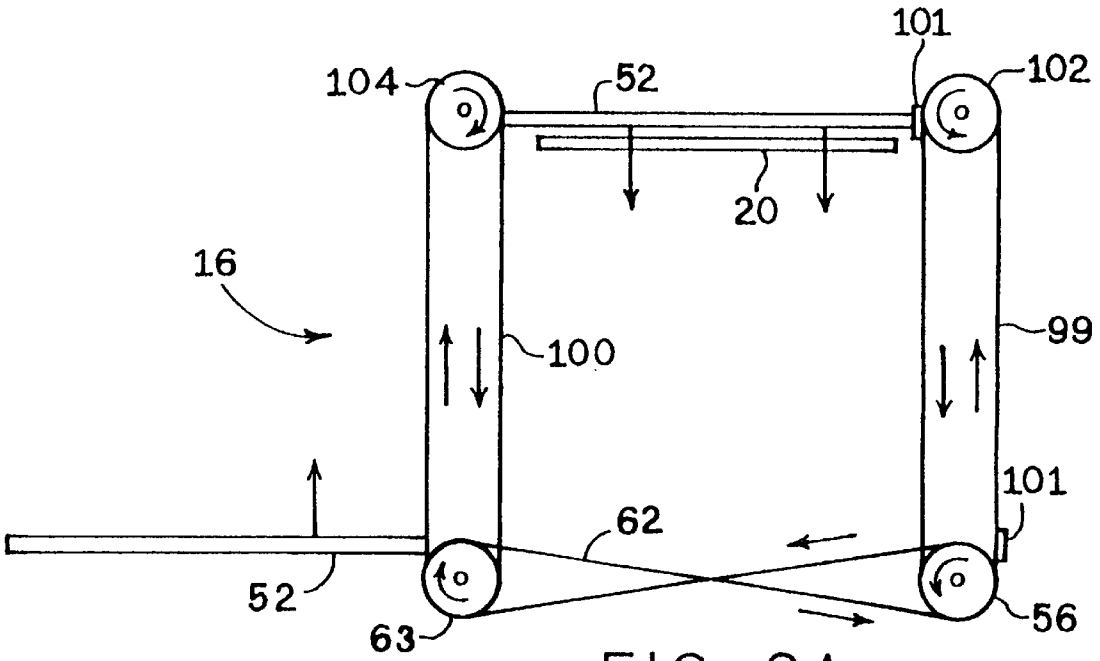
FIG. 3A shows a modified version of the embodiment of FIG. 3.

In FIG. 3A, breaker bars 52 are mounted only on the left drive belt 100, and extend entirely across the width of web 20 to right drive belt 99. Right drive belt 99 has receptacles 101 cooperatively spaced with respect to the spacing of bars 52 on drive belt 100.

Both belts 99, 100 are driven at a common speed, with cooperative timing such that as each breaker bar traverses about pulley 104 and extends across web 20 toward belt 99, a receptacle 101 on advancing belt 99 comes into alignment with the breaker bar and temporarily receives, supports, and preferably locks onto, the distal end of the breaker bar remote from belt 100. Accordingly, each breaker bar 52 is permanently mounted to belt 100, and is temporarily mounted and secured to belt 99 while traversing the web-breaking downward portion of its closed-loop path. The distal end of the breaker bar is released from the respective receptacle 101 at the end of the downward portion of the path, thereafter traversing about drive apparatus 63 and along the upward portion of the closed-loop path back to pulley 104.

Locking onto the breaker bar means restraining the breaker bar at least with respect to (e.g. upward or downward) movement toward or away from the surface of the web which is engaged by the breaker bar.

Thus, in the FIG. 3A version of this embodiment, each breaker bar is permanently mounted to only one of the belts 99, 100. The permanent mount can, of course, be to either such belt, with receptacles 101 being mounted on the other belt.

As in other embodiments of this invention, driving of breaker bars is preferably intermittent, and incremental along the respective closed loop paths, as controlled by controller 26.

Figure 4:
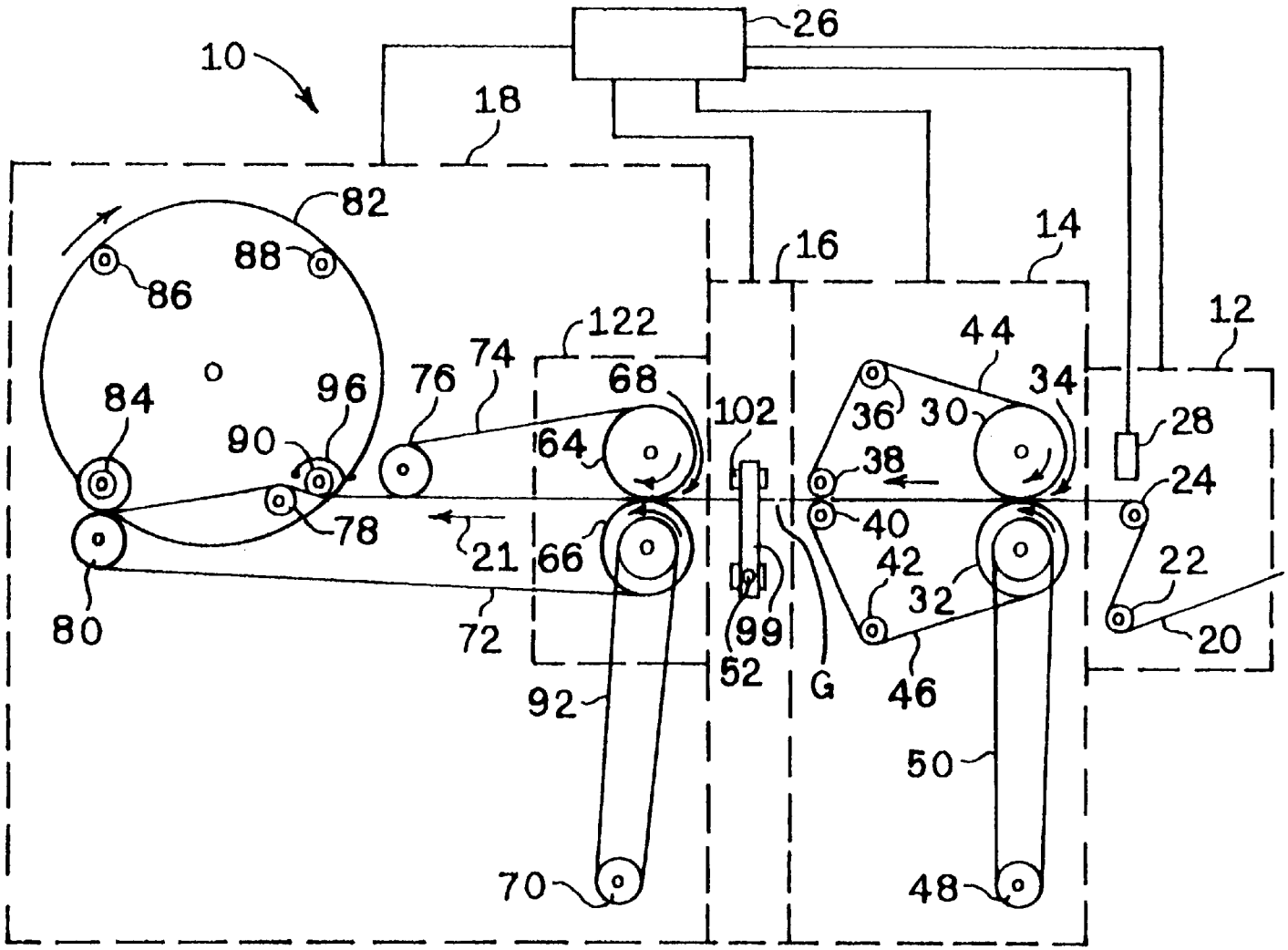
FIG. 4 shows a representative side view of the embodiment of FIG. 3, in a web handling machine of the invention.

FIG. 4 shows a side view of breaker bar assembly 16 of FIG. 3 in web handling machine 10. As with respect to FIGS. 1 and 2, in this embodiment, the length of gap "G" is between rolls 38, 40 and nip 68 is less than 5 inches, preferably less than 3 inches, most preferably about one to two inches or less. Web 20 is unsupported across gap "G."

As the web extends across the gap, gravity urges the unsupported leading portion 98 of the web downwardly. Stiffness inherent in the web tends to keep the leading portion 98 moving in a straight line, generally horizontal direction. The longer the unsupported length of the web across gap "G," the greater the gravity effect. Thus, the longer the gap, the greater the possibility that gravity will overcome the inherent stiffness in the web, bending the web downwardly such that the web will not feed properly to nip 68. However, the compact length of breaker bar assembly 16 of the invention, and the respectively reduced length of gap "G," reduces the distance the web travels unsupported, and thus the effect of gravity on the unsupported web. Because the web crosses the shorter gap "G" in the invention, rather than the relatively longer gaps of prior art machines, there is less likelihood of the web mis-feeding due to web 20 bending downwardly while crossing gap "G." Hence web handling machine 10 has greater reliability than prior art web handling machines.

In practice, because of the reduced length of gap "G," gravity imposes only nominal practical limitations, at gap "G," on processes for fabricating webs commonly used to make plastic bags of e.g. about 0.5 mil to about 2.0 mils thickness of the plastic web. The shorter gap "G" thus makes the machine 10 more versatile in that it can handle thinner webs through gap "G."

Figure 5:
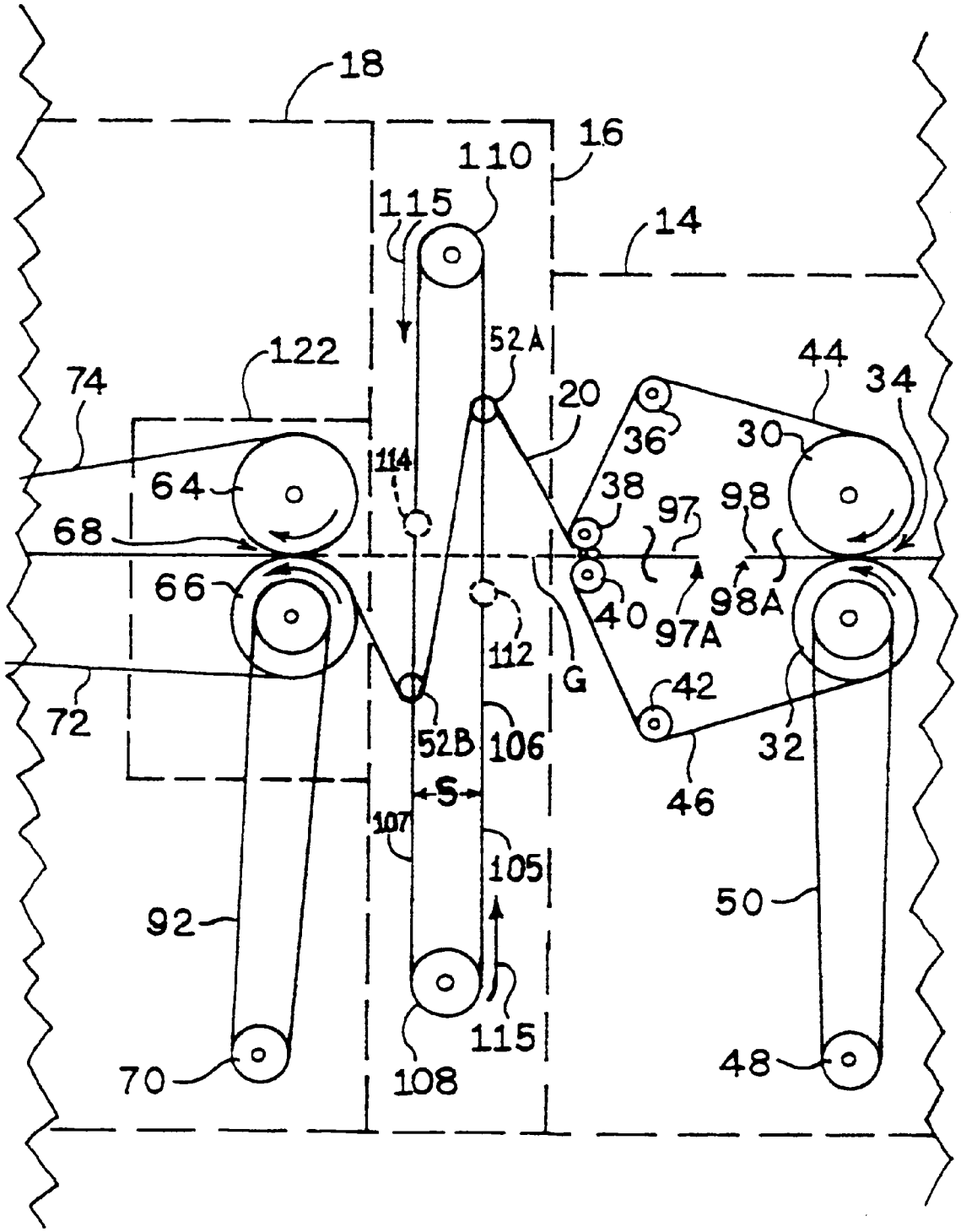
FIG. 5 shows a representative enlarged partial side view of a fragment of a third embodiment of the invention.

FIG. 5 illustrates a side view of a fragment of web handling machine 10 including a third embodiment of breaker bar assembly 16 having two breaker bars 52A, 52B engaging web 20 at spaced locations along the length of the web, to tension and then break the web. As illustrated in FIGS. 5 and 6, breaker bars 52 are mounted to drive belts 105 and 116 adjacent first and second edges 120A, 120B, respectively. Drive belt 105 is mounted on drive apparatus 108 and guide apparatus 110. Guide apparatus 110 and drive apparatus 108 are preferably sprockets, pulleys, or the like driven by a servomotor, standard AC motor or the like. Locations 112 and 114 show the positions of respective breaker bars 52 in a rest position before being driven into engagement with web 20.

Drive belt 116 is mounted on second drive apparatus 126, and guide apparatus 118. Drive belts 105 and 116 are mounted in the web handling machine 10 adjacent the respective edges of the web. First ends of breaker bars 52 are mounted to drive belt 105. Second ends of breaker bars 52 are mounted to drive belt 116.

Support belts 44, 46 are omitted between nip 34 and rolls 38, 40, showing where web 20 breaks when engaged and stressed by breaker bars 52. Drive belt 105 and guide apparatus 110 are disposed in a first generally planar surface adjacent and extending generally alongside edge 120A of web 20. Similarly, drive belt 116 and guide apparatus 118 are disposed in a second generally planar surface, adjacent and extending generally alongside edge 120B. See FIG. 6.

Referring to FIGS. 5 and 6, winding assembly 18 includes nip subassembly 122, forming nip 68, which securely engages and grips web 20 after the leading edge of the remainder of the web crosses gap "G." Nips 34 and 68 provide nip anchor points against which breaker bars 52 break the web.

In operation, first breaker bar 52A nearest guide rolls 38 and 40 moves upward in a straight line direction along first path segment 106 while second breaker bar 52B moves downward in a straight line direction along a second path segment 107 into no more than modestly stressing engagement with web 20, taking up the slack. The directions of travel along path segments 106 and 107 are shown by arrows 115. This movement of first and second breaker bars 52 takes up slack in web 20 by simultaneously extending the web in upward and downward directions. Breaker bars 52 continue to move in the given directions, continuing to take up the slack, as the web continues to feed across the gap. At the appropriate time, and as controlled by controller 26, breaker bars 52 break web 20 by temporarily making a step increase in their speed of traverse along the path. The break creates a trailing edge 97A of a first (leading) workpiece, and a leading edge 98A of a second (trailing and yet to be separated from the web) workpiece.

After breaking the web, breaker bars 52 move to rest positions illustrated at e.g. 112, 114 in FIG. 5, and wait there until the newly formed leading edge 98A again feeds across the gap and enters nip 68. The controller then again signals the breaker bars to take up the slack, and subsequently to break the web as described above.

As viewed in FIG. 5, first path segment 106 comprises the straight line traversed upward by drive belt 105 from the right edge of driving apparatus 108 to the right edge of guide apparatus 110. Likewise, the second path segment 107 comprises the straight line traversed downward by drive belt 105 from the left edge of guide apparatus 110 downward to the left edge of driving apparatus 108. First and second straight line path segments 106 and 107, in combination with the curved segments about drive apparatus 108 and guide apparatus 110, form a single elongate closed path. The breaker bars 52 move generally along the elongate closed path in a straight line direction, before engaging web 20, while taking up the slack, while breaking the web, and after web 20 breaks. The breaker bars, of course, traverse arcuate portions of the path about drive apparatus 108 and guide apparatus 110.

The respective straight line segments 106, 107 of the first and second paths are located between respective outside edges of driving apparatus 108 and guide apparatus 110. Each such straight line segment is at least about 4 inches in length. Preferably, each such straight line path segment (106 and 107) is about 8 to about 10 inches long. Longer path segments are acceptable.

Lateral spacing "S" (FIG. 5) of first path segment 106 from second path segment 107 comprises a distance of no more than 1.5 inches, preferably between 0.25 inch and 1 inch. There must, of course, be sufficient clearance between the path segments to allow breaker bars 52 to pass one another without interfacing contact while traversing the elongate closed path.

While FIG. 5 only shows two breaker bars mounted to drive belt 105, more are contemplated. Any number of breaker bars 52 can function as long as there is proper spacing between operative pairs of bars 52. Namely, spacing between bars 52 must be sufficient that a following bar does not interfere with feeding the leading edge 98A of the web across gap "G." In addition, the spacing from nip 68, across bar 52B to driving apparatus 108, must be long enough that trailing edge 97A does not become engaged with driving apparatus 108.

Elements of second guide apparatus 118 preferably correspond to the elements recited for first guide apparatus 110. Second drive belt 116 is driven by first drive apparatus 108 via drive shaft 119. First and second drive belts 105 and 116 are thus driven at a common speed such that each breaker bar 52 engages the entire width "W" of the web all at once.

Figure 6A:
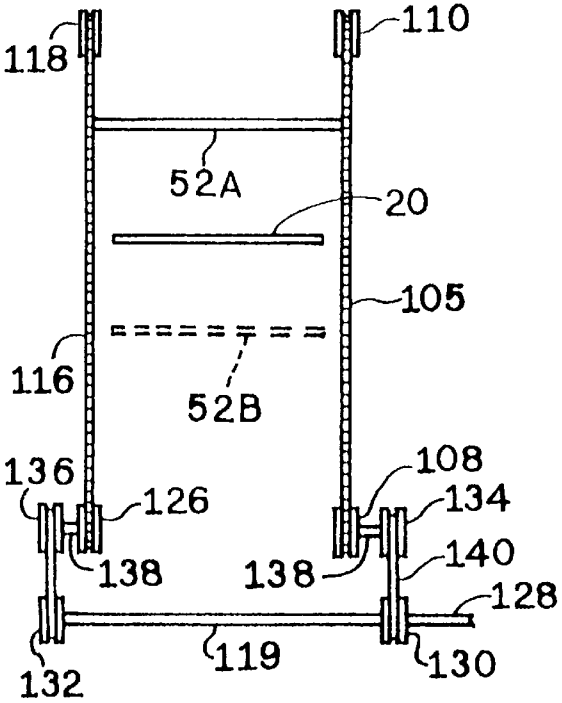
FIG. 6A shows a front view of a preferred drive system for the embodiment of FIG. 5.
Figure 6:
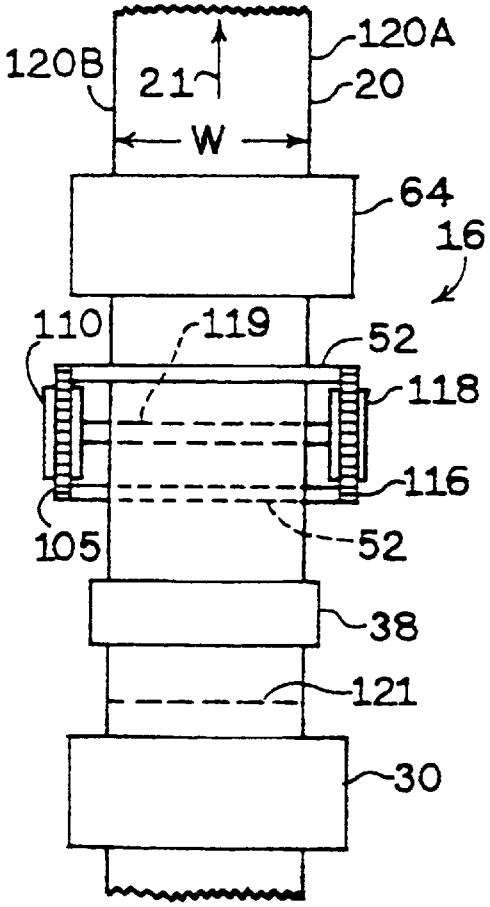
FIG. 6 shows a representative top view of the embodiment of FIG. 5.

FIG. 6A illustrates a preferred arrangement of drive shaft 119. As seen therein, drive shaft 119 is driven from line shaft 128 through appropriate coupling (not shown). Spaced pulleys 130, 132 are mounted on and driven by drive shaft 119. Pulleys 134, 136 are mounted adjacent respective drive apparatus 108, 126, and are connected thereto by stub shafts 138. Drive belts 140 connect pulleys 130, 132 to respective pulleys 134, 136. When line shaft 128 rotates, it causes rotation of shaft 119. Rotation of shaft 119 causes rotation of pulleys 130, 132, drive belts 140, pulleys 134, 136, stub shafts 138, and thus drive apparatus 108 and 126.

FIG. 6 illustrates guide roll 38 and driven roll 30, but not web support belt 44 or guide roll 36, in order to show a line of weakness 121 at a location preferably occupied by each line of weakness when the web is broken. Line of weakness 121 can comprise perforations, slits, weakened portions which have not been cut through, or the like. The line of weakness 121 preferably extends entirely across web 20 in a direction transverse to the path travelled by web 20. The line of weakness 121 preferably is at the position shown in FIG. 6, or even closer to driven roll 30 when the web is broken by the action of breaker bars 52.

In the shingling mode of operation, as the breaker bars 52 break web 20, the downstream breaker bar 52 pulls the trailing edge 97A of trailing portion 97 of the workpiece downward from nips 34 and 68. Leading edge 98A then extends over trailing edge 97A, overlying trailing portion 97. The trailing edge 97A and the leading edge 98A are then, together, drawn through second nip 68, and thence to winding turret 82.

Figure 7:
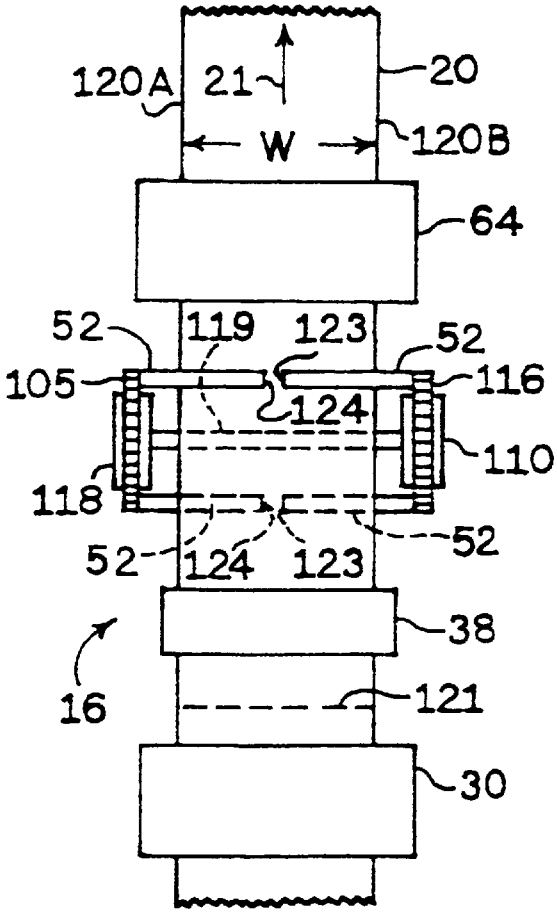
FIG. 7 shows a top view of a fourth embodiment of the invention.

FIG. 7 shows a top view of another embodiment of the invention, similar to that in FIGS. 5 and 6. Drive belt 105 supports at least two breaker bars 52. Drive belt 116 supports at least two breaker bars 52. Respective breaker bars 52 on drive belts 105, 116 are in substantial alignment with each other, across the web, much like the alignment discussed with respect to FIGS. 2, 3, and 6. The selected breaker bars 52 from each respective drive belt 105, 116 advance in corresponding upward and downward straight line directions before, during and after contact with web 20. The path segments traveled by the breaker bars 52 on belts 105 and 116 as the bars advance about driving apparatus 56, guide apparatus 102, drive apparatus 63, and guide apparatus 104, comprise a pair of elongate closed paths as in FIGS. 5 and 6. The paths are similar in size and shape, and are adjacent the respective first and second edges 120A, 120B of web 20. Thus, breaker bars 52 on the first drive belt are aligned with the breaker bars on the second drive belt. The embodiment of FIG. 7 is similar to the embodiment of FIGS. 5 and 6, except for free ends 123, 124 of breaker bars 52 intermediate the width "W" of web 20.

Figure 8A:
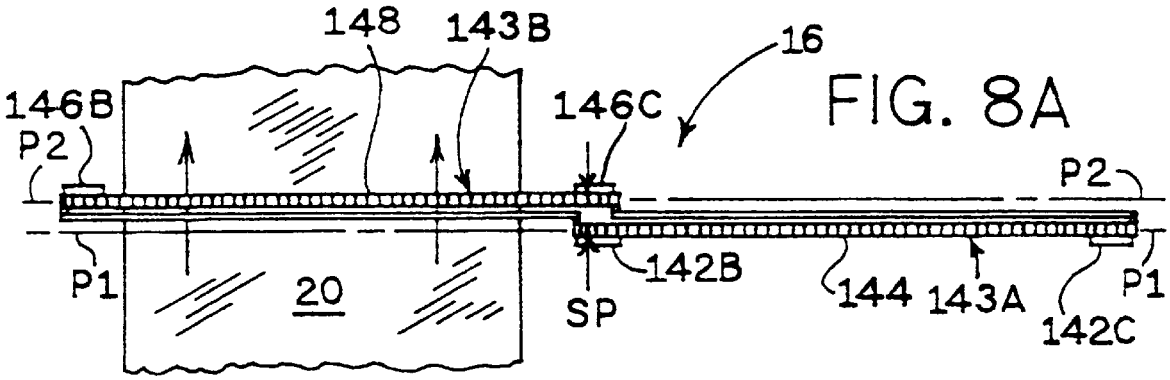
FIGS. 8A and 8B show representative top and side views respectively of a fifth embodiment of the invention.
Figure 8B:
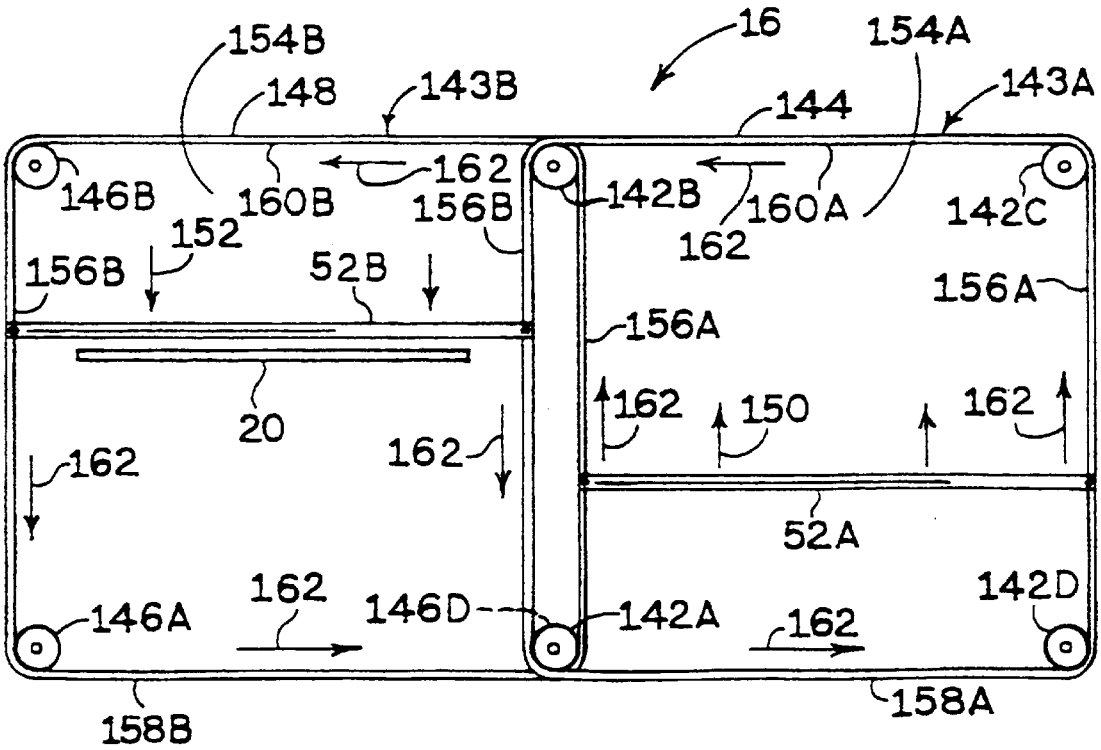

FIGS. 8A and 8B illustrate a further embodiment of the breaker bar assembly 16. Referring to FIGS. 8A and 8B in combination, breaker bar assembly 16 comprises first and second belt support assemblies 143A and 143B. In belt support assembly 143A, pulleys 142A, 142B, 142C, and 142D define a first closed-loop rectangular path, traversed by endless belt 144, and defined in a first containing surface such as plane "P1." In belt support assembly 143B, respective pulleys 146A, 146B, 146C, and 146D define a second closed loop rectangular path, traversed by endless belt 148, and defined in a second containing surface such as plane "P2" parallel to plane "P1."

Belt support assemblies 143A and 143B are spaced from each other by space "SP," and are laterally offset from each other. Belt support assembly 143B circumscribes the width of web 20. Belt support assembly 143A is laterally offset from web 20 as well as being offset, along the length of the web, from belt support assembly 143B.

Each breaker bar 52 is mounted to both of belts 144 and 148, for articulation with respect to both belts. As seen in FIG. 8A, the lengths of bars 52 are disposed parallel to belts 144 and 148 and planes "P1" and "P2," and are positioned between planes "P1" and "P2." The drawings show two breaker bars 52A, 52B. The number of breaker bars can be selected according to the needs of application of a particular web handling machine 10.

FIG. 8B illustrates the preferred path of travel of the breaker bars in the breaker bar assembly. As shown, breaker bar 52A is disposed adjacent belt support assembly 143A and will next move in an upward direction, as shown by the arrows 150. The right end of bar 52A is mounted to belt 144. The left end of bar 52A is mounted to belt 148. Breaker bar 52B is disposed adjacent belt support assembly 143B, is positioned proximate the top surface of web 20, and will next move in a downward direction, as shown by arrows 152. The right end of bar 52B is mounted to belt 144. The left end of bar 52B is mounted to belt 148. Accordingly, breaker bar 52A extends across a first opening 154A defined between legs 156A of belts 144, 148 along the right portions of the respective paths, and bar 52B extends across a second opening 154B defined between legs 156B of belts 144, 148 along the left portions of the respective paths.

Controller 26 controls a suitable drive mechanism, not shown, driving belts 144, 148 in unison, such that belts 144, 148 are driven at a common speed about their respective closed-loop paths. FIG. 8B shows that projections of the closed loop paths defined by belts 144, 148 overlap at pulleys 142A, 142B, 146C, and 146D. While such overlap is not necessary, overlap is desirable for compactness of the assembly 16.

In accord with the structure above described, and starting at the position of breaker bar 52B, driving of belts 144, 148 drives the breaker bar downwardly in opening 154B, engaging and breaking web 20. When the breaker bar reaches the bottom of opening 154B, belts 144, 148 carry the ends of the bar around pulleys 142A and 146A, and move the bar laterally along the bottom segments 158A, 158B of the paths traversed by belts 144, 148, to opening 154A. The bar then travels upwardly in opening 154A and is transferred laterally along top segments 160A, 160B of the paths traversed by belts 144, 148, to opening 154A. Back in opening 154A, the breaker bar again travels downwardly, again breaking the advancing web at a subsequent line of weakness 121. It will be appreciated that belt 148 travels around gap "G," and need not pass through gap "G."

Thus, each breaker bar 52 travels a closed-loop path downwardly in opening 154B, laterally to the right from opening 154B to opening 154A, upwardly in opening 154A, laterally to the left from opening 154A to opening 154B, and thence downwardly again in opening 154B. Breaker bar 52B shown, illustrates downward movement in opening 154B. Breaker bar 52A, shown, illustrates upward movement in opening 154A. Arrows 162 illustrate the paths of travel of belts 144, 148. Throughout travel of its closed loop path, each breaker bar maintains its e.g. parallel orientation with respect to the top surface of web 20.

Primary advantages of the embodiment of FIGS. 8A, 8B are that (1) both ends of a respective breaker bar are mounted in the breaker bar assembly, resulting in the strength and control inherent in mounting both ends, and (2) the length of the breaker bar assembly along the length of gap "G" can be limited to the space occupied by a single breaker bar, at opening 154B, and need not provide any length with respect to belt 148 or any other drive element. This embodiment thus provides the breaker bar with strength and control advantages of the embodiment of FIG. 5, of securing both ends of the breaker bar while breaking the web, in combination with the minimal gap lengths of such embodiments as those shown in FIGS. 1–3.

Where it is desirable to provide an upstream breaker bar 52A and a downstream breaker bar 52B for cooperating upwardly and downwardly driven engagement of the web as in FIG. 5, a pair of the breaker bar assemblies 16 of FIGS. 8A and 8B can be used. Namely, a second such breaker bar assembly 16 can be added to the layout, upstream (with respect to web travel) of the assembly shown, and with the web extending through the opening 154A wherein the breaker bars on the second breaker bar assembly travel in an upward direction to engage the web while the breaker bars on the first breaker bar assembly travel in a downward direction to engage the web.

Throughout the above disclosure, the invention has been illustrated with a horizontal web 20 and downward movement of breaker bars 52 into breaking engagement with the web. In the embodiments of FIGS. 5–7, breaking engagement comprehends a second, upwardly moving, breaker bar cooperating with the downwardly-moving breaker bar in breaking the web.

The actual orientation of the web with respect to horizontal is not limited to that illustrated. For example, the web-breaking operation can be satisfactorily performed on an upwardly or downwardly inclined web, including a web advancing vertically (either up or down), or on a web running on one edge, such as where edge 120B is vertically or angularly above or below edge 120A.

Similarly, breaking the web need not be accompanied by any downward movement of a breaker bar. Rather, it is important only that appropriate provision be made to feed the leading edge 98A of the remainder of the web across the gap to nip 68, and to properly orient and position the leading portion with respect to trailing portion 97 when operating in the shingling mode. Preferably, the trailing edge is urged generally downwardly or laterally when broken away from the web. However, upward urgings can also be tolerated because of the short length of the gap "G," and the respective limited affect of gravitational forces.

Those skilled in the art will now see that certain modifications can be made to the apparatus and methods herein disclosed with respect to the illustrated embodiments, without departing from the spirit of the instant invention. And while the invention has been described above with respect to the preferred embodiments, it will be understood that the invention is adapted to numerous rearrangements, modifications, and alterations, and all such arrangements, modifications, and alterations are intended to be within the scope of the appended claims.

Having thus described the invention, what is claimed is:

1. A method of breaking a web at spaced lines of weakness extending transversely across the web, the web traveling along a process path in a longitudinal direction, the method comprising:

(a) advancing the web through a first nip;

(b) drawing the web through a second nip, and through a breaker assembly between the first and second nips, the breaker assembly comprising at least a first breaker element, and driving apparatus driving the breaker assembly;

(c) sensing a line of weakness in the web; and (d) advancing the at least first breaker element along a closed-loop path in a first breaking direction segment of the closed-loop path, and then advancing the at least first breaker element in a second opposing return direction segment of the closed-loop path, the first breaking segment of the closed-loop path carrying said at least first breaker element through at least a portion of the process path and thus into engagement with the web, thereby causing the web to break at one of the spaced lines of weakness, the entirety of the second return segment of the closed-loop path not crossing the process path.

2. A method as in claim 1 wherein the breaker assembly includes at least a second breaker element in an opposed closed-loop path having a first breaking direction segment and a second return direction segment, the method including advancing the first and second breaker elements, in the respective first breaking direction segments, into cooperating alignment to cooperatively engage the web on a common side of the web along a common line, and advancing each of the first and second breaker elements along the respective second return segments of the respective closed-loop paths wherein the entireties of the second return direction segments of the respective close-loop paths do not cross the process path.

3. A method as in claim 2, including disposing the first and second breaker elements in a common plane across the web, driving the first and second breaker elements in opposing rotary directions, and timing advance of the first and second breaker elements such that the first breaker element cooperates with the second breaker element across a top surface of the web such that the respective two breaker bars cooperatively engage and break the web.

4. A method as in claim 3, including rotating the first and second breaker bars into alignment with each other so that the respective breaker bars simultaneously engage and break the web.

5. A method as in claim 1, including engaging the web with the breaker element at a downstream location displaced from the respective line of weakness thereby to break the web at the line of weakness.

6. A method as in claim 1, the web having first and second opposing edges extending along the length of the web, the second return segment being disposed outwardly from one of the first and second opposing edges of the web.

7. A method as in claim 2, the web having first and second opposing edges extending along the length of the web, the second return segments being disposed outwardly from the respective first and second opposing edges of the web.

8. A method as in claim 1 wherein the first breaking direction segment of the closed-loop path defines a first straight-line segment thereof during engagement of the breaker element with the web, and the second return direction segment of the second path defines a second straight-line segment of the closed-loop path.

* * * * *